US008011395B2

(12) United States Patent
Yuyama

(10) Patent No.: US 8,011,395 B2
(45) Date of Patent: Sep. 6, 2011

(54) TABLET FEEDING DEVICE

(75) Inventor: Shoji Yuyama, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 519 days.

(21) Appl. No.: 12/302,268

(22) PCT Filed: May 17, 2007

(86) PCT No.: PCT/JP2007/060119

§ 371 (c)(1),
(2), (4) Date: Nov. 24, 2008

(87) PCT Pub. No.: WO2007/135945

PCT Pub. Date: Nov. 29, 2007

(65) Prior Publication Data

US 2009/0301603 A1 Dec. 10, 2009

(30) Foreign Application Priority Data

May 24, 2006 (JP) ..... 2006-144242

(51) Int. Cl.
*B65B 1/04* (2006.01)

(52) U.S. Cl. ..... 141/234; 141/104

(58) Field of Classification Search ..... 141/102, 141/104, 105, 107, 234, 247, 171; 53/237, 53/249

See application file for complete search history.

(56) References Cited

U.S. PATENT DOCUMENTS 4,811,764 A * 3/1989 McLaughlin ..... 141/98
5,348,061 A * 9/1994 Riley et al. ..... 141/104
5,765,606 A * 6/1998 Takemasa et al. ..... 141/104
6,311,743 B1 * 11/2001 Baroncini ..... 141/234
7,721,508 B2 * 5/2010 Yuyama et al. ..... 53/249
2007/0157551 A1 7/2007 Yuyama et al.

FOREIGN PATENT DOCUMENTS

JP 11-070901 3/1999
JP 2002-264902 9/2002
WO WO 2005/073086 8/2005

OTHER PUBLICATIONS

International Search Report for PCT/JP2007/060119, 2 pages (mailed Aug. 14, 2007).

* cited by examiner

*Primary Examiner* — Davis Hwu
(74) *Attorney, Agent, or Firm* — Jones Day

(57) ABSTRACT

The present invention relates to a tablet feeding device for supplying tablets accommodated in a tablet feeder to vials by supplying a power source from a surface side of the tablet feeder to a rotor of the tablet feeder and further allowing many tablet feeders to be mounted with high density.

The tablet feeder 21 has a stationary guide member 119 having a stationary tilt plate 119*c* and a movable guide member 121 having a movable tilt plate 121*c*. The stationary tilt plate 119*c* is disposed adjacent to a tablet outlet 112 of the tablet feeder 21 and guides the tablets discharged from the tablet outlet 112 to the vials 4. The movable tilt plate 121*c* is movable between a receiving position and an operating position in association with an attachment and detachment of a driving means 202 with the tablet feeder 21. The movable tilt plate 121*c* overlaps with the stationary tilt plate 119*c* at the receiving position and continues to the stationary tilt plate 119*c* at the operating position. The tablet feeder 21 positioned below is formed with a cutout 118 into which the movable member guide member 121 enters when the movable guide member 121 of the tablet feeder 21 positioned above is moved to the operating position.

3 Claims, 17 Drawing Sheets

(a)

(b)

TABLET FEEDING DEVICE

CROSS-REFERENCE TO RELATED APPLICATIONS

This application is a 35 U.S.C. §371 National Stage filing of International Application No. PCT/JP2007/060119, filed under the Patent Cooperation Treaty on May 17, 2007, and claims priority under 35 U.S.C. §119 to Japanese Patent Application No. 2006-144242, filed May 24, 2006, both of which are incorporated by reference herein in their entireties.

TECHNICAL FIELD

The present invention relates to a tablet feeding device of a tablet filling device for filling tablets in vials as prescribed.

BACKGROUND ART

Japanese Laid-Open Patent Publication No. (Hei) 11-070901 discloses a tablet filling device adapted to perform the following functions: mounting a tablet cassette filled with tablets on a motor base; holding the tablets in a groove formed in a rotor through rotating the rotor within the tablet cassette by receiving a driving force from a built-in motor of the motor base; and discharging the tablets from an outlet of the tablet cassette via a tablet path within the motor base to a rear surface of a plate provided with the motor base.

SUMMARY OF THE INVENTION

However, for a large-sized tablet filling device required for many tablet cassettes, motors that are built in each motor base are necessary (as many as the number of tablet cassettes). Thus, this inevitably increases the associated costs while complicating motor control. Japanese Patent Application No. 2005-052008, which was filed by the present applicant, discloses that a power source is provided to a rotor of a tablet cassette by: preparing a simple mounting base wherein a built-in motor is removed from each motor; and causing an outer single driving means such as a robot arm to be closer from a rear surface of an installation plate of the mounting base.

However, if the robot arm is provided at the rear side of the installation plate of the mounting base, since it is disadvantageous in terms of maintaining the robot arm, it is desirable to discharge the robot arm to a surface side of the tablet cassette. In such a case, since forming the tablet path in an outlet of the tablet cassette interferes with the tablet cassette mounted right under the tablet path, the tablet cassettes must inevitably be disposed. Accordingly, numerous tablet cassettes cannot be mounted with high density.

Thus, the present invention is directed to providing a tablet feeding device capable of supplying the tablets accommodated in the tablet feeder to the vials by supplying a power source from the surface side of the tablet feeder to a rotor of the tablet feeder and further mounting numerous tablet feeders with high density.

In order to solve such a problem, the present invention provides a tablet feeding device for supplying tablets to vials by removably disposing a tablet feeder in a plurality of mounting bases, supplying a power source to a rotor of the tablet feeder from an outer driving means and discharging the tablets accommodated in each tablet feeder from a tablet outlet. The tablet feeder includes a stationary guide member having a stationary tilt plate and a movable guide member having a movable tilt plate. The stationary tilt plate is disposed adjacent to the tablet outlet of the tablet feeder and guides the tablets discharged from the tablet outlet to the vials. The movable tilt plate is movable between a receiving position and an operating position in association with an attachment and detachment of the driving means with the tablet feeder. The movable tilt plate overlaps with the stationary tilt plate at the receiving position and continues to the stationary tilt plate at the operating position. The tablet feeder positioned below is formed with a cutout into which the movable guide member enters when the moveable guide member of the tablet feeder positioned above is moved to the operating position.

According to this constitution, if the outer driving means approaches from the surface side of the tablet feeder, the movable guide member is moved to the operating position in association therewith and enters into the cutout of the tablet feeder positioned below, thereby forming a long tilt plate from the stationary tilt plate of the stationary guide member to the movable tilt plate of the movable guide member. Thus, the tablets accommodated in the tablet feeder can be supplied to the vials by supplying the power source from the surface side of the tablet feeder to the rotor of the tablet feeder. Further, if the outer driving means is separated from the surface side of the tablet feeder, then the movable guide member is moved to the receiving position in association therewith and departs from the cutout of the tablet feeder positioned below. Thus, since the movable tilt plate of the movable guide member overlaps with the stationary tilt plate of the stationary guide member, the tablet feeder positioned below can be withdrawn without interfering with the guide member of the tablet feeder positioned above. As such, many tablet feeders can be mounted with high density.

It is preferable to further comprise an opening/closing member for opening and closing the tablet outlet in association with the attachment and detachment of the driving means with the tablet feeder. By doing so, the tablets hung on the tablet outlet of the tablet feeder can be prevented from dropping when the tablet feeder is attached or detached.

Preferably, the movable guide member is moved to the operating position in association with an opening operation of the opening/closing member and the movable guide member is moved to the receiving position in association with a closing operation of the opening/closing member. By doing so, the opening/closing member and the movable guide member can be operated by a single attaching and detaching operation of the outer driving means. Thus, a structure is simple and the operation is accurate.

According to the present invention, when the outer driving means approaches from the surface side of the tablet feeder, the long tilt plate is extended from the stationary tilt plate of the stationary guide member to the movable tilt plate of the movable guide member. Thus, the tablets accommodated in the tablet feeder can be supplied to the vials by supplying the power source from the surface side of the tablet feeder to the rotor of the tablet feeder. Further, if the outer driving means is separated from the surface side of the tablet feeder, the movable guide member is moved to the receiving position and departs from the cutout of the tablet feeder positioned below. The movable tilt plate of the movable guide member overlaps with the stationary tilt plate of the stationary guide member. Thus, the tablet feeder positioned below can be withdrawn without interfering with the guide member of the tablet feeder positioned above. Accordingly, many tablet feeders can be mounted with high density.

DESCRIPTION OF SYMBOLS

4 . . . vial,
16 . . . tablet supply unit,
21 . . . tablet feeder,
110 . . . rotor,
112 . . . tablet outlet,
118 . . . cutout,
119 . . . stationary guide member,
119*c* . . . tilt plate,
120 . . . opening/closing member,
121 . . . movable guide member,
121*b* . . . tilt plate,
202 . . . arm (driving means).

DETAILED DESCRIPTION

Hereinafter, the embodiments of the present invention will be explained with reference to the accompanying drawings.

Figure 1:
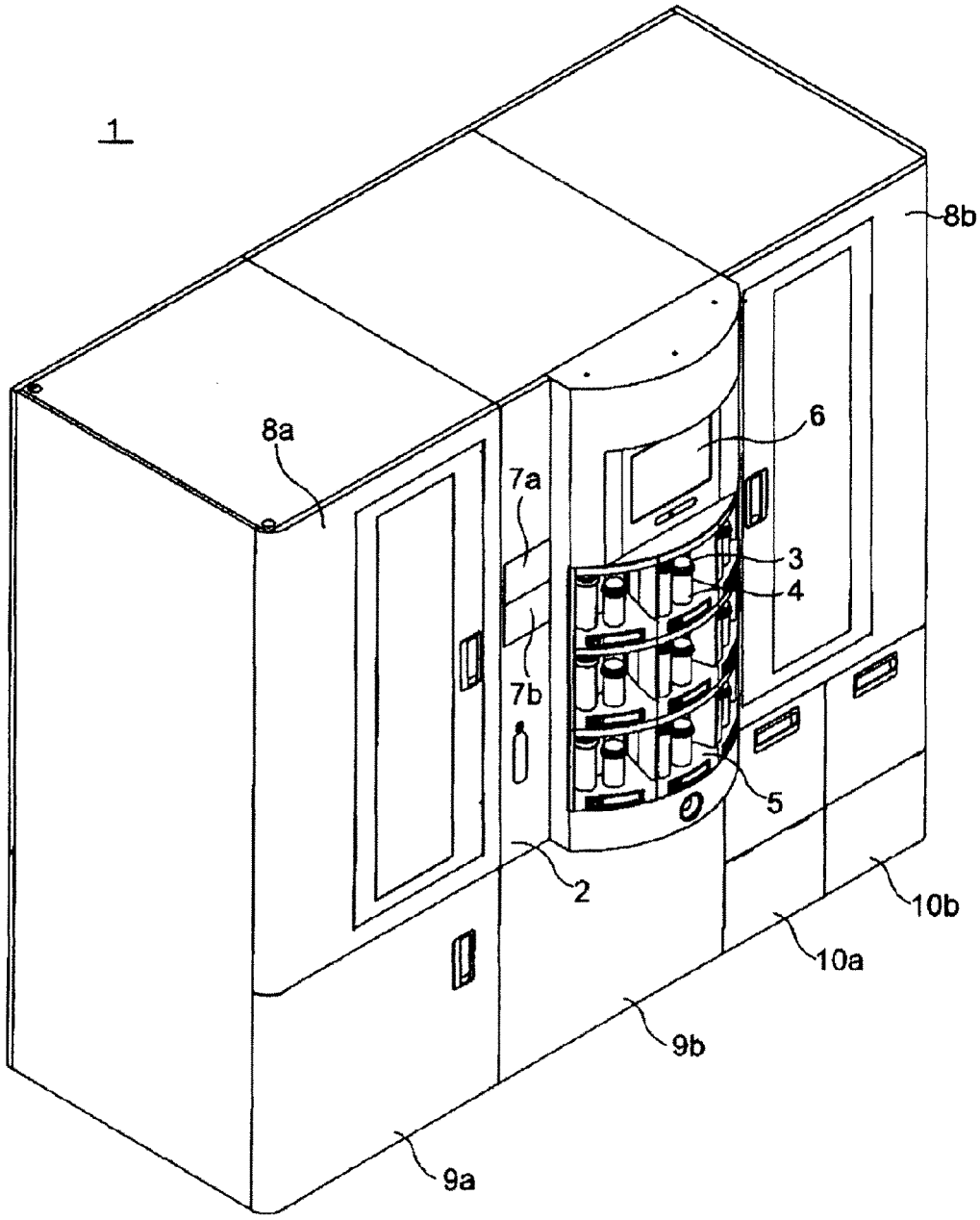
FIG. 1 is a perspective view of a tablet filling device according to the present invention.

FIG. 1 shows an exterior of a tablet filling device 1 according to an embodiment of the present invention. Nine extracting shelves 5 are placed at a center door 2, which is provided at a front center of the tablet filling device 1. Vials 4 filled with tablets and closed by a cap 3 are stacked from an inner side in the extracting shelves 5. The extracting shelves 5 are protruded forward and bent so as to easily extract the vials 4. An operation display screen 6 for displaying the required information by operating the tablet filling device 1 is provided at an upper direction of the extracting shelves 5. Cap inlets 7*a* and 7*b* for inputting big and small caps 3*a* and 3*b* are formed at a left side of the extracting shelf 5. Left and right doors 8*a* and 8*b*, which are opened and closed when attaching and detaching a tablet feeder 21, are provided at both sides of the center door 2. A door 9*a* for checking an inner device is provided at a lower direction of the left side door 8*a*. A closet 9*b* for checking the inner device is provided at a lower direction of the center door 2. Two doors 10*a* and 10*b* for inputting the big and small vials 4*a* and 4*b* are provided at a lower direction of the right side door 8*b*.

Figure 2:
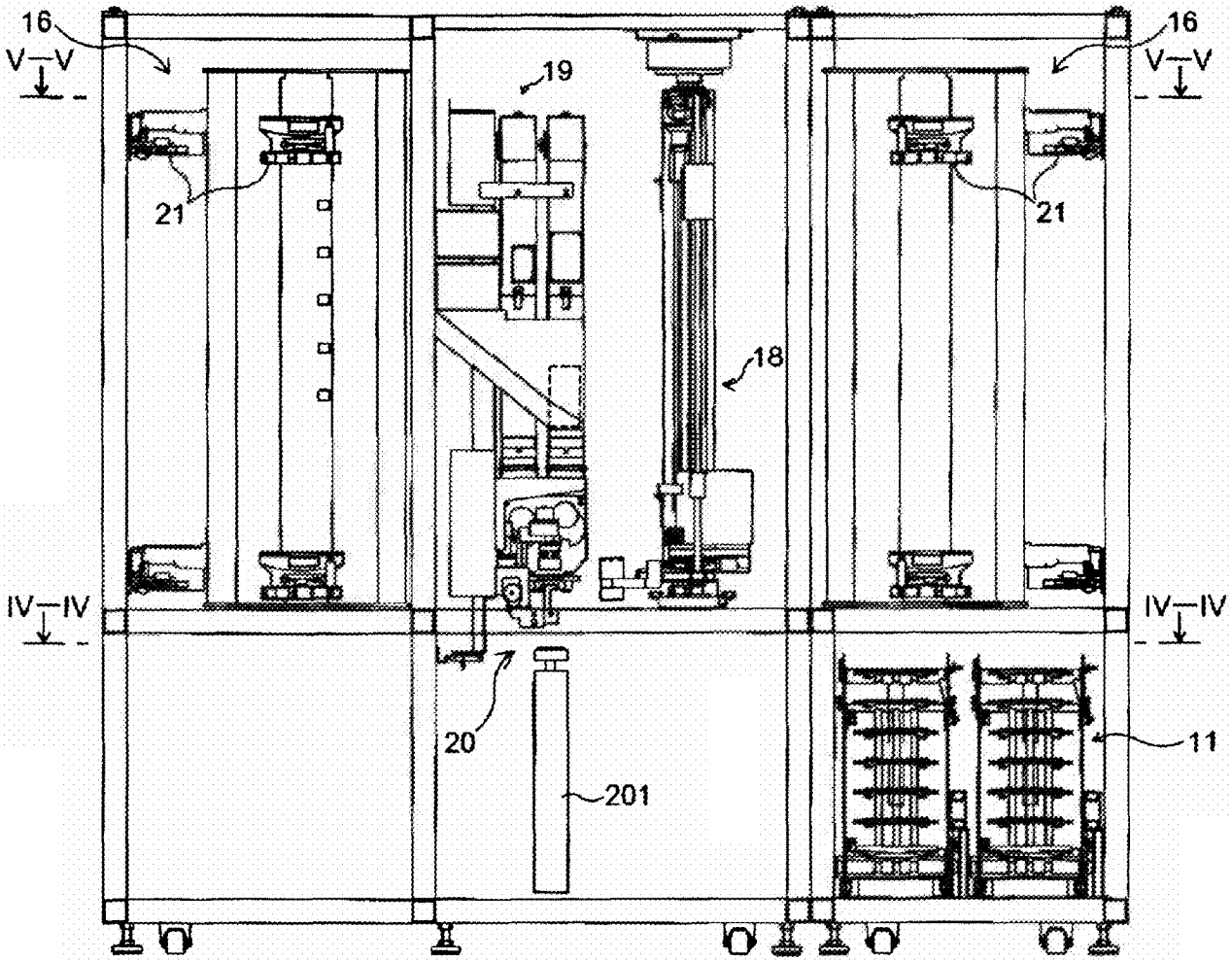
FIG. 2 is a front view illustrating the removal of a door of the tablet filling device.
Figure 3:
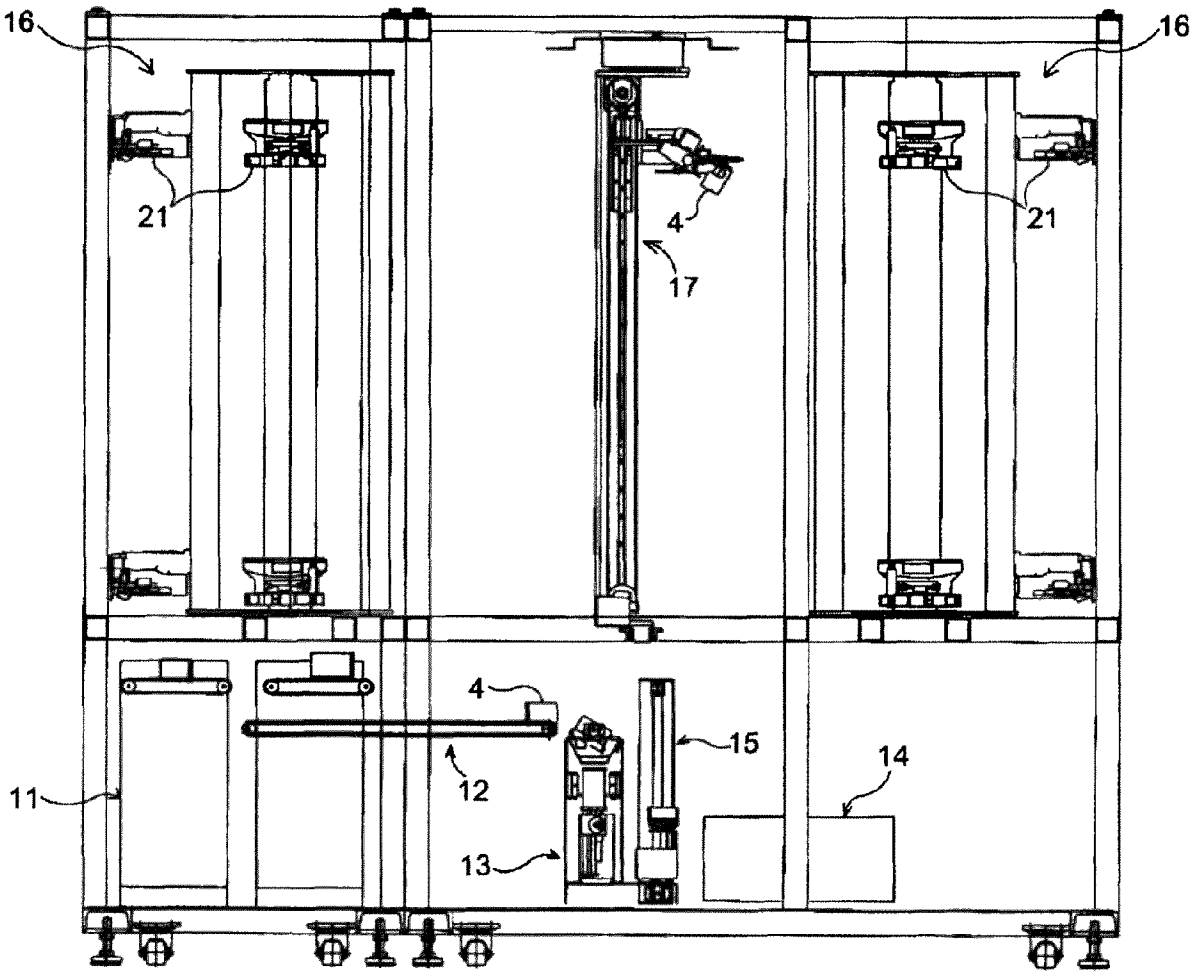
FIG. 3 is a rear view illustrating the removal of an exterior plate of the tablet filling device.
Figure 4:
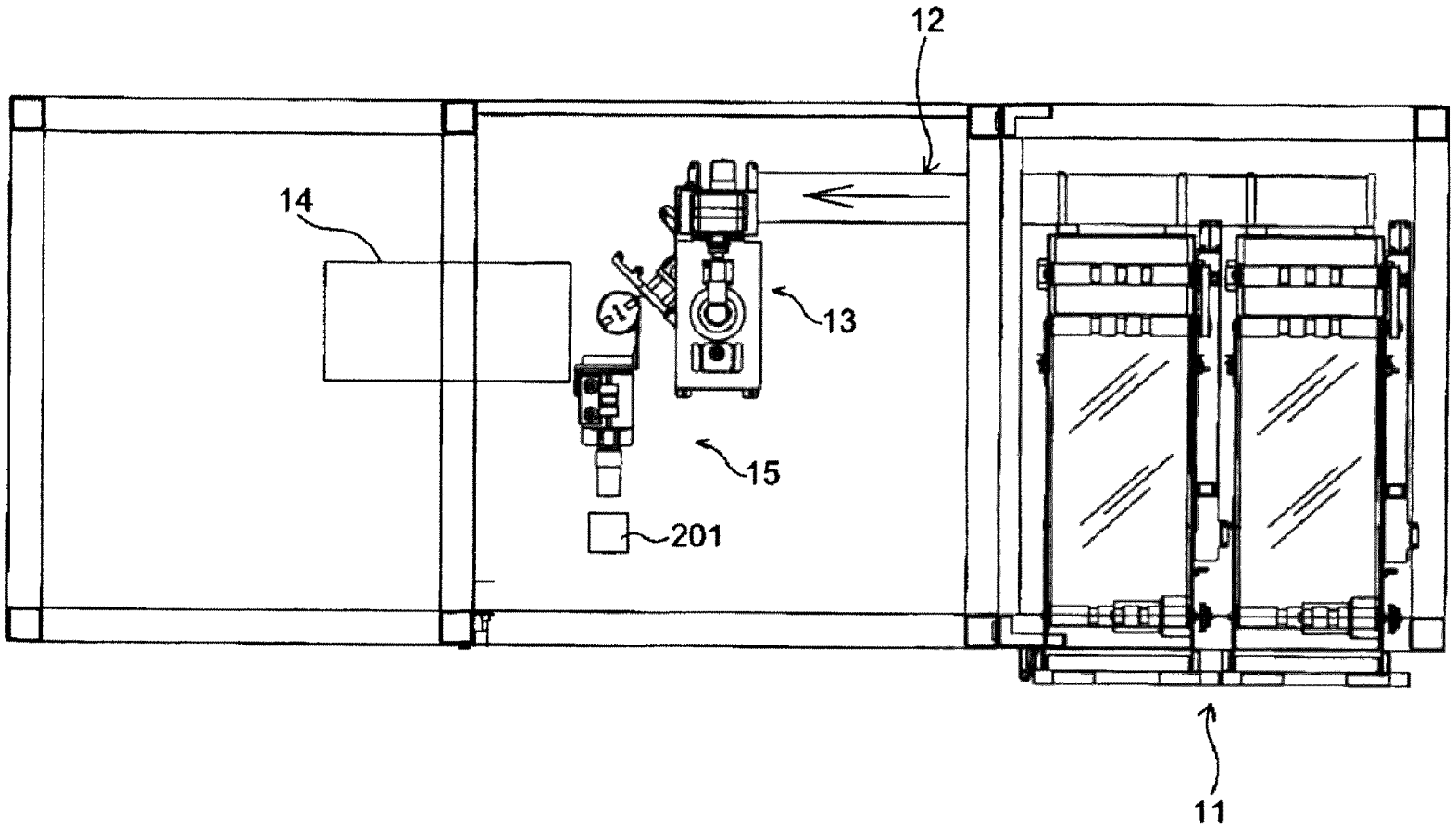
FIG. 4 is a cross-sectional view taken along the line IV-IV of FIG. 2.
Figure 5:
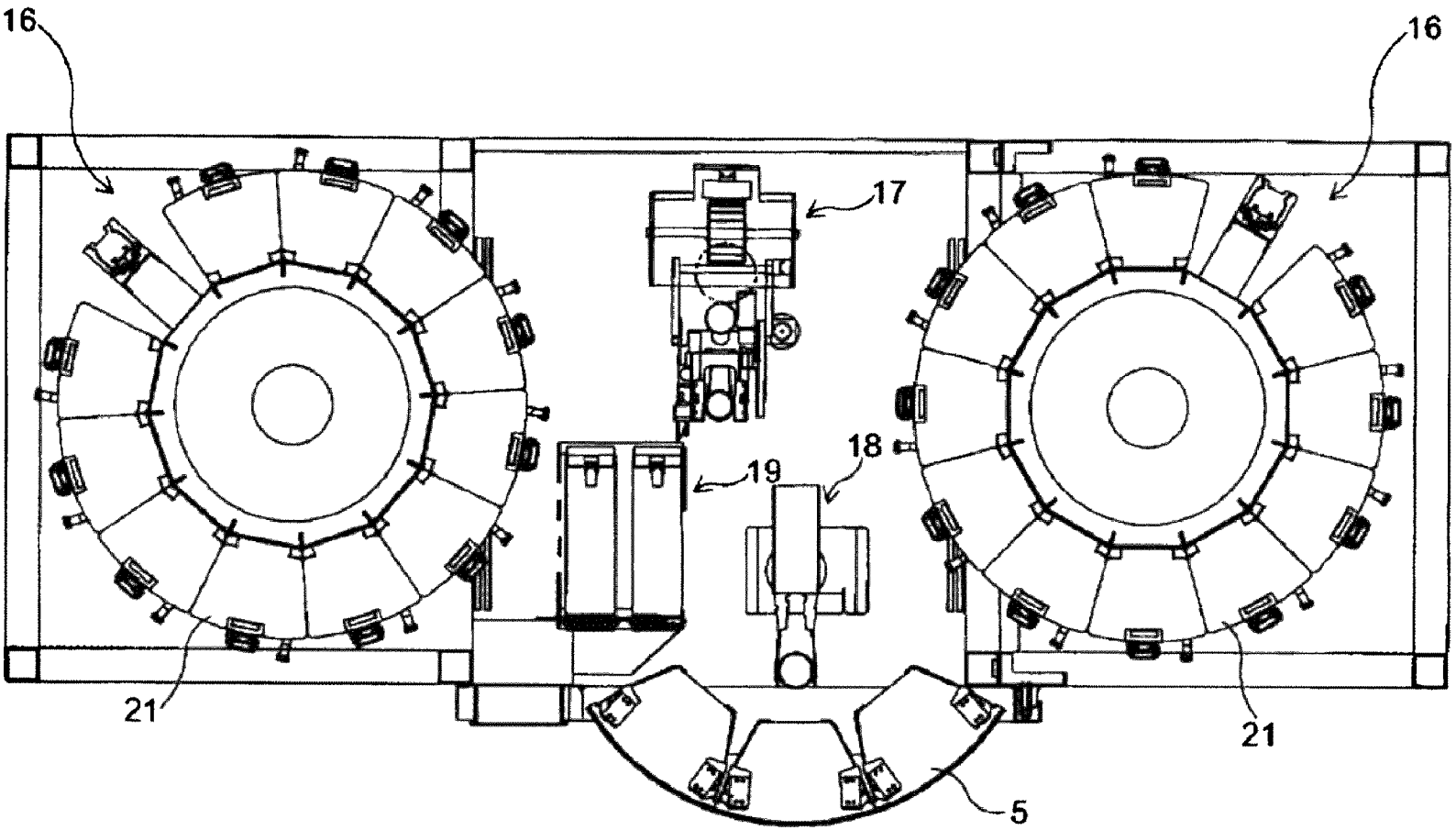
FIG. 5 is a cross-sectional view taken along the line V-V of FIG. 2.

FIG. 2 is a front view illustrating the removal of the door of the tablet filling device. FIG. 3 is a rear view illustrating the removal of an exterior plate of the tablet filling device. FIG. 4 is a cross-sectional view taken along the line IV-IV of FIG. 2. FIG. 5 is a cross-sectional view taken along the line V-V of FIG. 2. As shown in the above figures, the tablet filling device 1 comprises two vial supply units 11, a vial conveyance belt 12, a vial conveyance arm unit 13, a labeling unit 14, a vial lift unit 15, two tablet supply units 16, a first vial delivery arm unit 17, a second vial delivery arm unit 18, a cap supply unit 19 and a capping unit 20.

Two vial supply units 11 are provided at a right lower portion (when viewed from the front). The vial supply units 11 store the big and small vials 4, and extract and supply the vials 4 required for receiving the tablets as prescribed.

The vial conveyance belt 12 is provided at a rear of the vial supply unit 11 and horizontally extended toward the center, thereby conveying the vials 4 supplied from the vial supply unit 11 to the vial conveyance arm unit 13.

The vial conveyance arm unit 13 is positioned at an end section of the vial conveyance belt 12 and changes a direction of the vials 4 conveyed from the vial conveyance belt 12 so as to be opened upward. Thereafter, it conveys the vials 4 to the labeling unit 14 and the vial lift unit 15.

The labeling unit 14 is positioned at a left lower portion (when viewed from the front) and attaches a label to the vials 4 conveyed from the vial conveyance arm unit 13.

The vial lift unit 15 is positioned between the labeling unit 14 and the vial conveyance arm unit 13. The vial lift unit 15 lifts the vials 4 labeled by the labeling unit 14 to thereby deliver them to the first vial delivery arm unit 17.

The tablet supply unit 16 is positioned at right and left sides (when viewed from the front). The tablet supply unit 16 has numerous tablet feeders 21 provided around a rotatable drum 101 and discharges the tablets as prescribed from the tablet feeder 21, thereby supplying the tablets to the vials 4 held in the first vial delivery arm unit.

The first vial delivery arm unit 17 is positioned at a rear side and between two tablet supply units 16. The first vial delivery arm unit 17 receives the vials 4 from the vial lift unit 15 and moves to any tablet feeder 21 of the tablet supply unit 16. It then delivers the vials 4 to the second vial delivery arm unit 18 when the tablets according to the prescriptions are filled.

The second vial delivery arm unit 18 is positioned at a front side and between two tablet supply units 16. The second vial delivery arm unit 18 delivers the vials 4 received from the first vial delivery arm unit 17 to the capping unit 20, thereby capping the vials 4 and stacking the capped vials 4 in the extracting shelf 5.

The cap supply unit 19 is positioned at a left side (when viewed from the front) of the second vial delivery arm unit 18. The cap supply unit 19 receives two types of caps 3 (i.e., big and small caps 3) used for closing the vials 4 and supplies any one of the caps 3 one by one.

The capping unit 20 is positioned at a lower direction of the cap supply unit 19 provided with the caps 3 supplied from the cap supply unit 19 to the vials 4 received from the second vial delivery arm unit 18.

Hereinafter, the tablet supply unit 16, the first vial delivery arm unit 17 and the second vial delivery arm unit 18 (i.e., the tablet feeding device of the present invention) will be explained in detail.

<Tablet Supply Unit>

Figure 6:
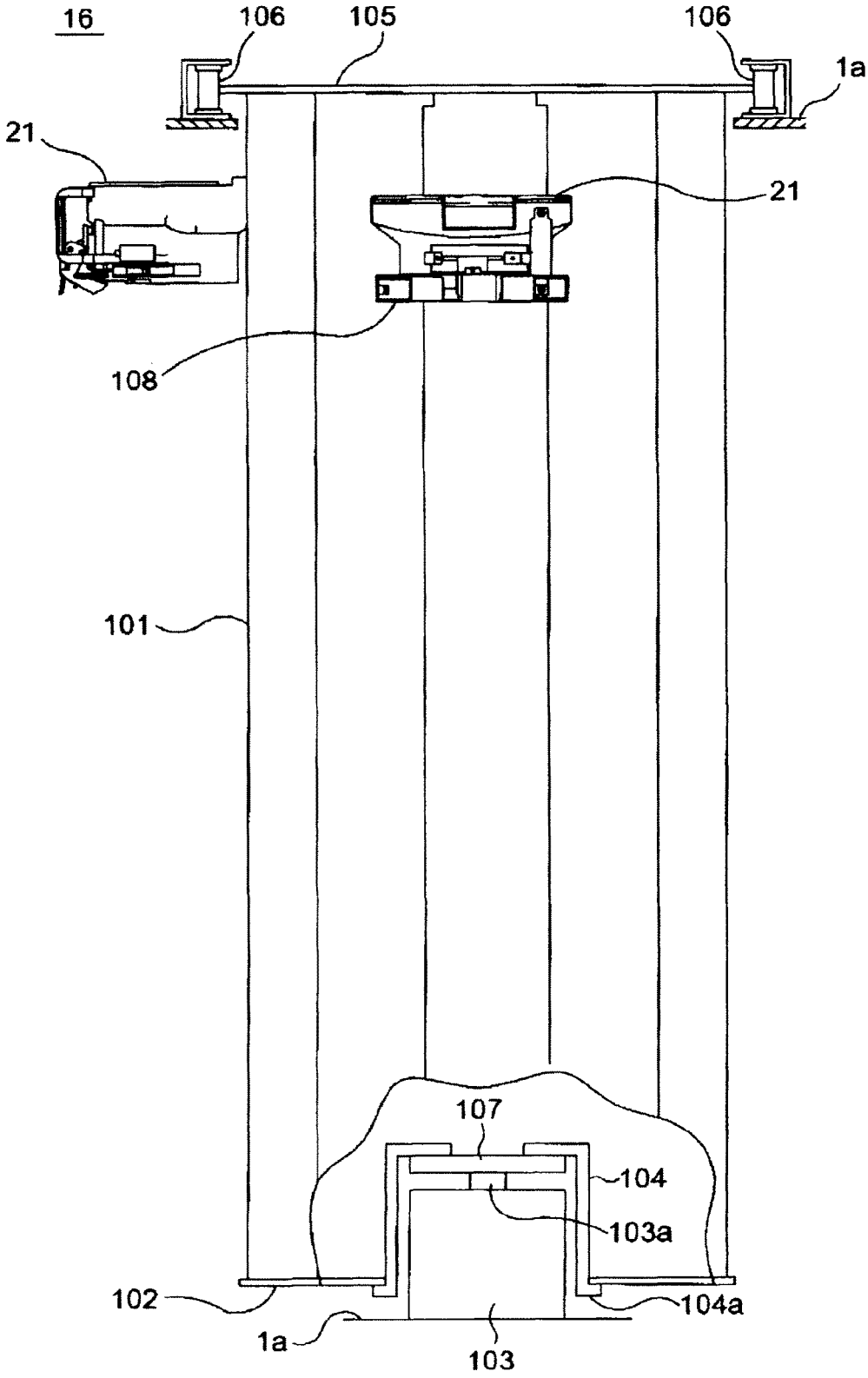
FIG. 6 is a front view of a tablet supply unit.

FIG. 6 shows the tablet supply unit 16. The tablet supply unit 16 has a drum 101 having a generally cylindrical shape. A lower side plate 102 provided at a lower end of the drum 101 is stacked on a flange 104*a* of a driving barrel 104 of a motor 103 fixed at a device body 1*a*. An outer periphery of an upper side plate 105 provided at an upper end of the drum 101 is supported at a plurality of rollers 106 provided in the device body 1*a*. The driving can 104 of the motor 103 is covered on an outer side of the motor 103 and provided at a driving plate 107 adhered to a driving shaft 103*a* of the motor 103. As such, since the motor 103 is positioned inside the drum 101 and there is neither motor 103 nor driving gear at an outer side of the drum 101, the structure is simple to thereby prevent the invention from increasing in size.

Figure 7:
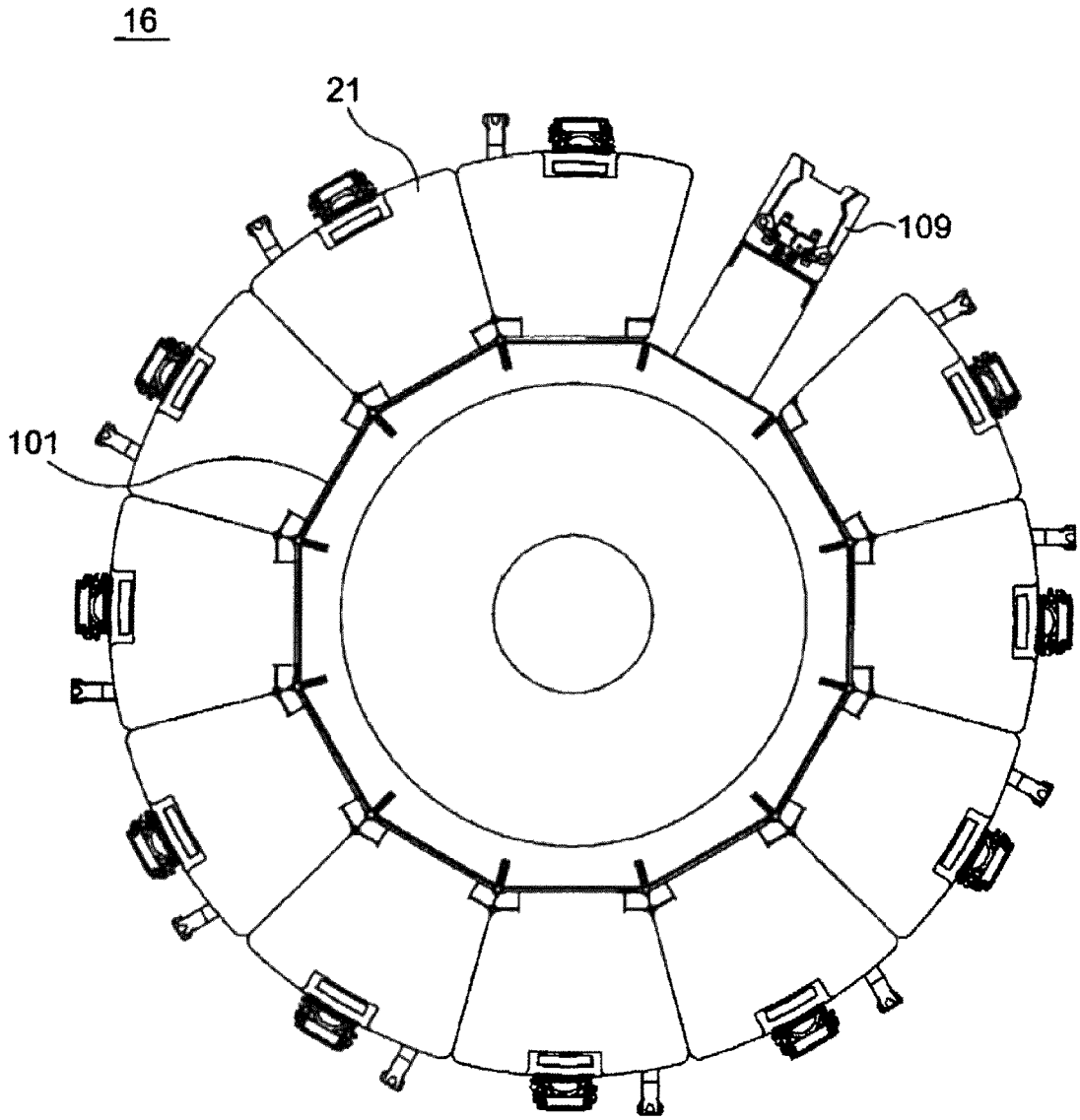
FIG. 7 is a plan view of the tablet supply unit.

Many mounting bases 108 for mounting the tablet feeders 21 are provided at an outer surface of the drum 101 in a circumferential direction and a vertical direction. As shown in FIG. 7, a plurality of clips 109 are provided at a part of the outer surface of the drum 101 along a vertical direction so as to temporarily store the vials 4.

Figure 8:
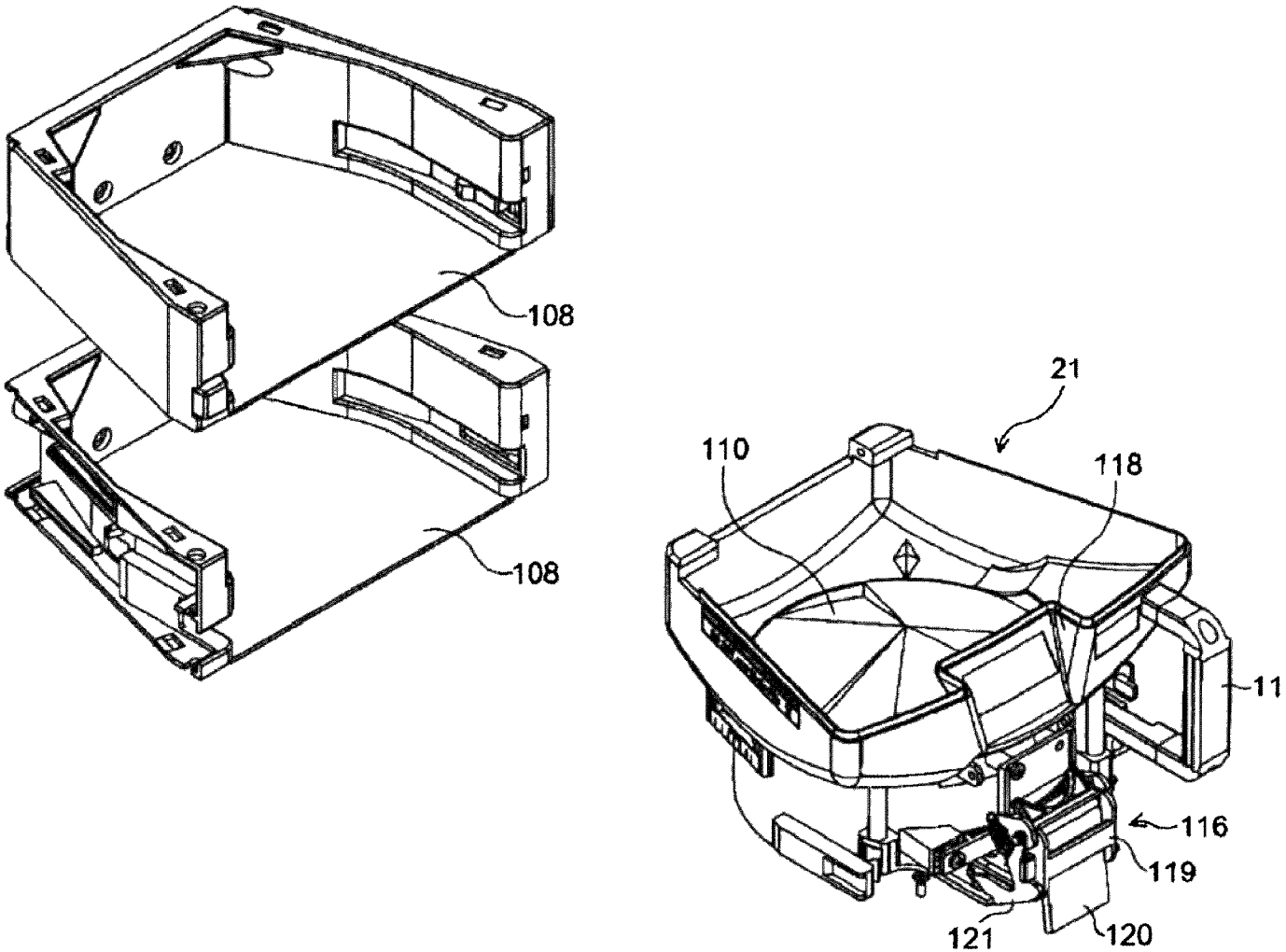
FIG. 8 is a perspective view of a tablet feeder and its mounting base.
Figure 9:
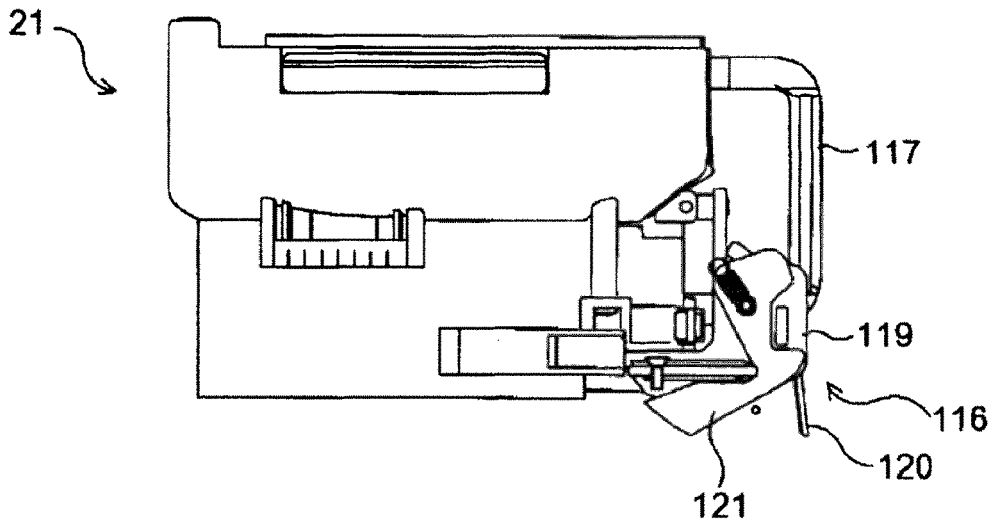
FIG. 9 is a side view (a) and a bottom view (b) of the tablet feeder.
Figure 9:
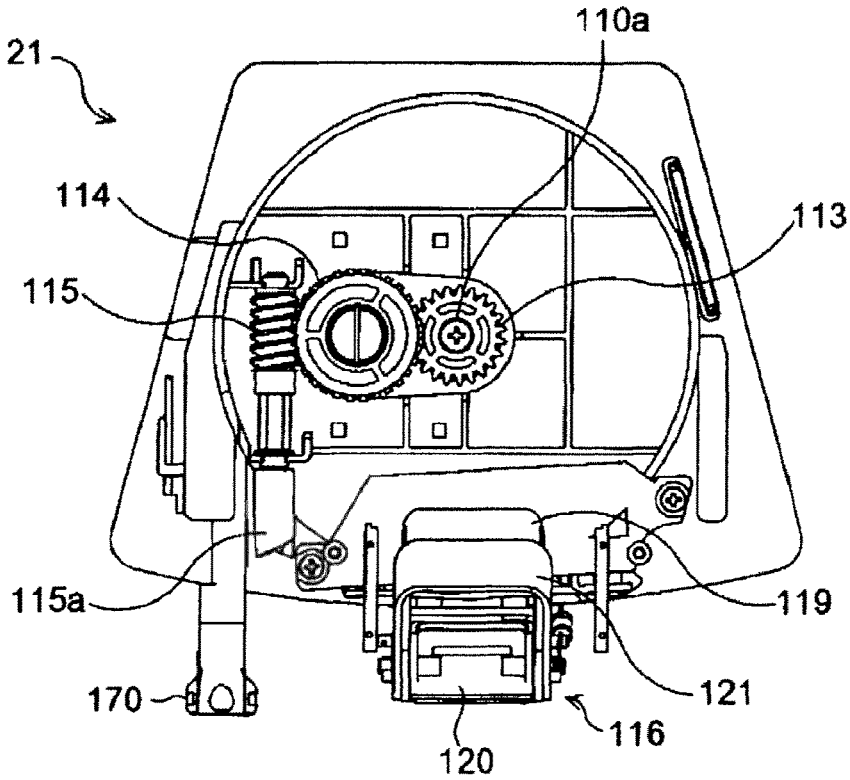

As shown in FIG. 8, the tablet feeder 21 has a container shape, which allows a significant number of the tablets to be received. The tablet feeder 21 is configured to hold the tablets T in a groove 111 shown in FIG. 11 formed at an outer periphery of a rotor 110 by a rotation of the rotor 110 provided at a bottom of the tablet feeder 21 and discharged from a tablet outlet 112. As shown in FIG. 9(*b*), a driving gear 113 is provided at a rotary shaft 110*a* of the rotor 110 protruded from the bottom of the tablet feeder 21 and connected to a worm gear 115 via an intermediate gear 114. The worm gear 115 is configured to be rotated by receiving a power source from the outside. As such, a coupling portion 115*a* is provided at a leading end of the worm gear 115. A driving shaft 214 of an arm 202 of the first vial delivery arm unit 17 (see FIG. 14) is coupled to the coupling portion 115*a*. The tablet outlet 112 of the tablet feeder 21 is formed at a bottom of a surface side of the tablet feeder 21, which becomes a surface at the time of mounting. A guide unit 116 is provided around the tablet outlet 112 at the surface side of the tablet feeder 21. A handle 117 is provided at a side direction of the guide unit 116 and a cutout 118 is formed at an upper direction thereof.

The guide unit 116 of the tablet feeder 21 includes a stationary guide member 119, an opening/closing member 120 and a movable guide member 121.

Figure 10:
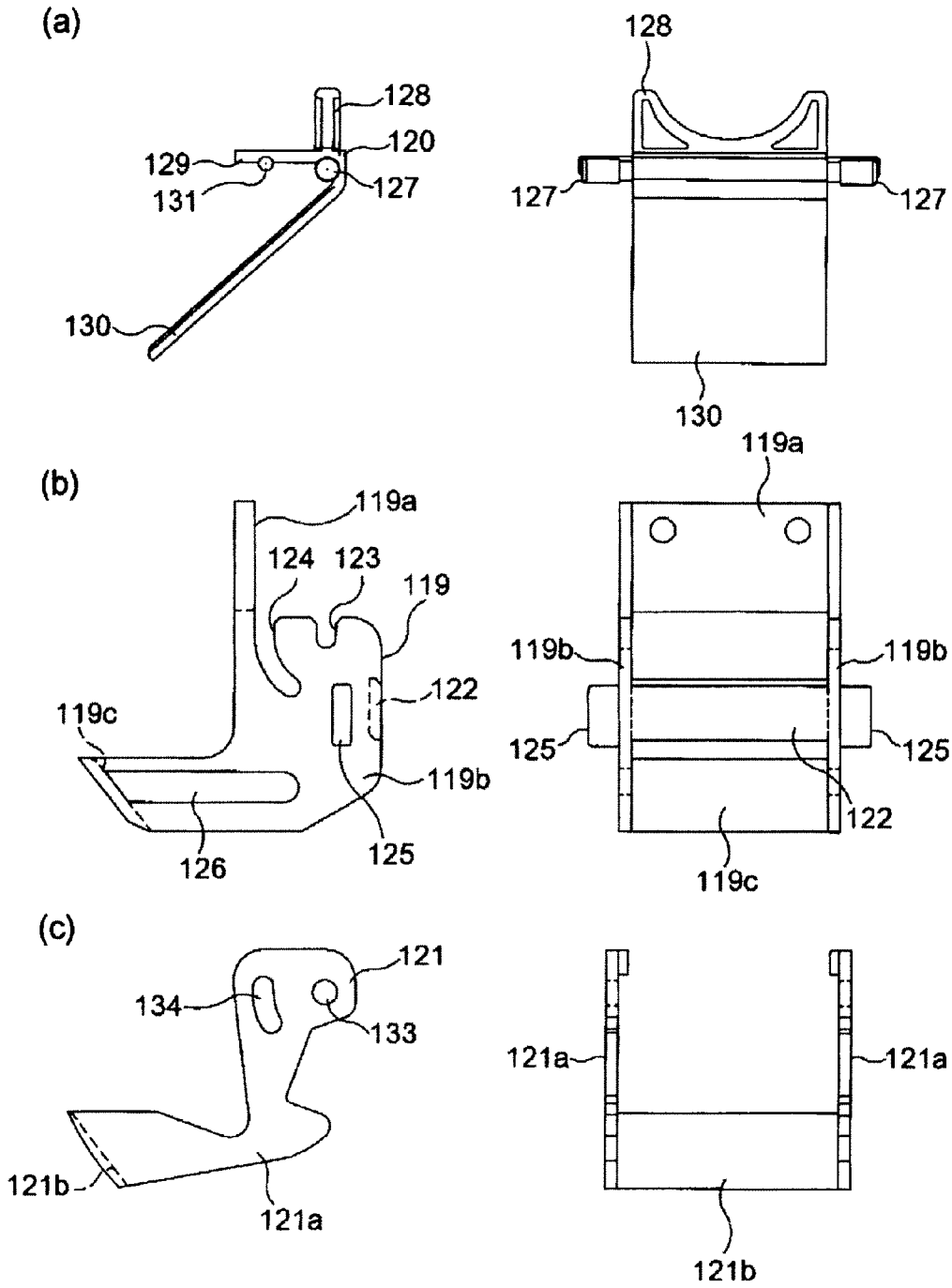
FIG. 10 is a side view and a front view of a closing/opening member, a stationary guide member and a movable guide member of a guide unit of the tablet feeder.

As shown in FIG. 10(*b*), the stationary guide member 119 includes a base 119*a*, side portions 119*b* and a tilt plate 119*c*. The base 119*a* is provided about an outer surface at the surface side of the tablet feeder 21. The side portions 119*b* are extended from both ends of the base 119*a* downwardly and horizontally to the sides of the tablet outlet 112. The tilt plate 119*c* connects leading ends of both side portions 119*b*. The side portions 119*b* are connected by a horizontal plate 122. A shaft hole 123 cutout having a U-shape and a groove 124 cutout having an arc shape around the shaft hole 123 are provided at an upper end of both side portions 119*b*. Further, a protrusion 125 is formed on an outer surface of both side portions 119*b*. Also, a slit 126 is formed at both side portions 119*b*. Light for detecting the tablets discharged from the tablet outlet 112 passes through the slit 126. The tilt plate 119*c* is inclined downward from the tablet outlet 112 toward the surface side of the tablet feeder 21.

As shown in FIG. 10(*a*), the opening/closing member 120 includes a driving piece 128, a stopper 129 and a cover 130 around a horizontal support shaft 127. Further, there is provided a pin 131 protruded at both ends from a leading end of the stopper 129. The support shaft 127 is fitted into the shaft hole 123 of the stationary guide member 119 and the pin 131 is inserted into the groove 124 of the stationary guide member 119. Further, one end of a coil spring 132 (see FIG. 11) is mounted on the pin 131 while the other end of each coil spring 132 is hung on a main body of the tablet feeder 21. As such, the opening/closing member 120 is pressed in a counterclockwise direction in FIG. 11. Thus, the driving piece 128 is upright. The stopper 129 contacts the base 119*a* of the stationary guide member 119 from a lower direction. Further, the cover 130 is close to a lower end of the tilt plate 119*c* of the stationary guide member 119. Moreover, a torsion spring may be mounted on the support shaft 127 instead of the coil spring 132. In such a case, one end of the torsion spring is hung on the protrusion 125 of the stationary guide member 119 while the other end is hung on the pin 131.

As shown in FIG. 10(*c*), the movable guide member 121 includes a pair of side portions 121*a* and a tilt plate 121*b*. The side portions 121*a* are extended in the vertical direction and then in the horizontal direction to both sides of the tablet outlet 112. The tilt plate 121*b* connects leading ends of both side portions 121*a*. The movable guide plate 121 is larger than the stationary guide member 119 and positioned at an outer side of the stationary guide member 119. Further, the tilt plate 121*b* is inclined downward from the tablet outlet 112 toward the surface side of the tablet feeder 21. A shaft hole 133 and a long hole having an arc shape around the shaft hole 133 are formed at both side portions 121*a*. The support shaft 127 of the opening/closing member 120 is fitted into the shaft hole 133 and the pin 131 of the opening/closing member 120 is inserted into the long hole 134. As such, the movable guide member 121 is configured to be rotatable between a receiving position of the drawing and an operating position of the drawing.

Figure 11:
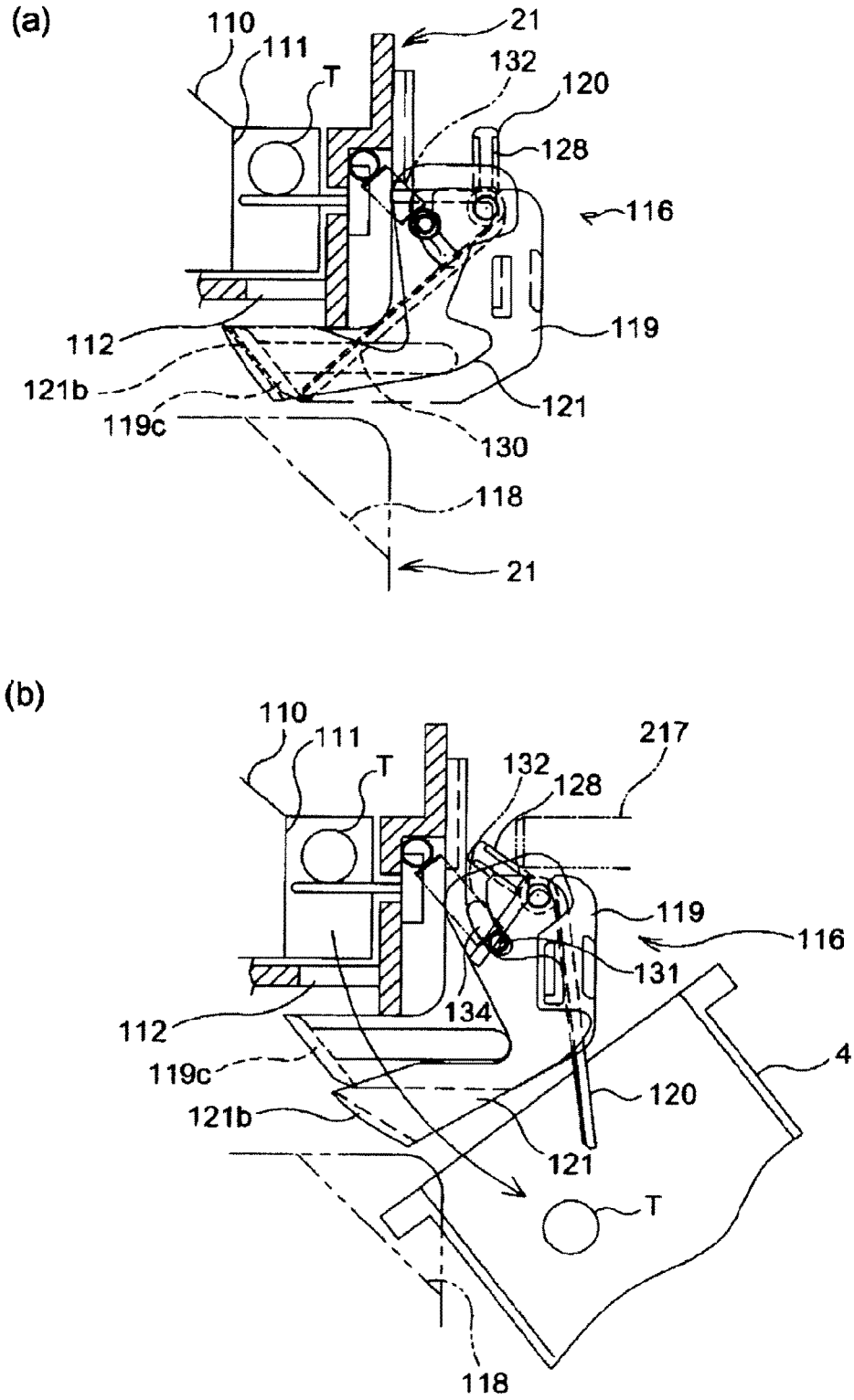
FIG. 11 is a side view during a non-operating state (a) and an operating state (b) of the guide unit of the tablet feeder.

Operations of the guide unit 116 will be explained below. In a general state, as shown in FIG. 11 (*a*), since the movable guide member 121 is located at the receiving position and the tilt plate 121*b* of the movable guide member 121 is received while being overlapped with the tilt plate 119*c* of the stationary guide member 119, the movable guide member 121 is not interfered with the tablet feeder 21 positioned at a lower direction. This allows the tablet feeder 21 positioned at a lower direction to be attached and detached. Further, since the cover 130 of the opening/closing member 120 is close to the lower end of the tilt plate 119*c* of the stationary guide member 119, a discharge path of the tablets T from the tablet outlet 112 is closed. The tablets T hung on the tablet outlet 112 when attaching and detaching the tablet feeder 21 does not fall.

Figure 12:
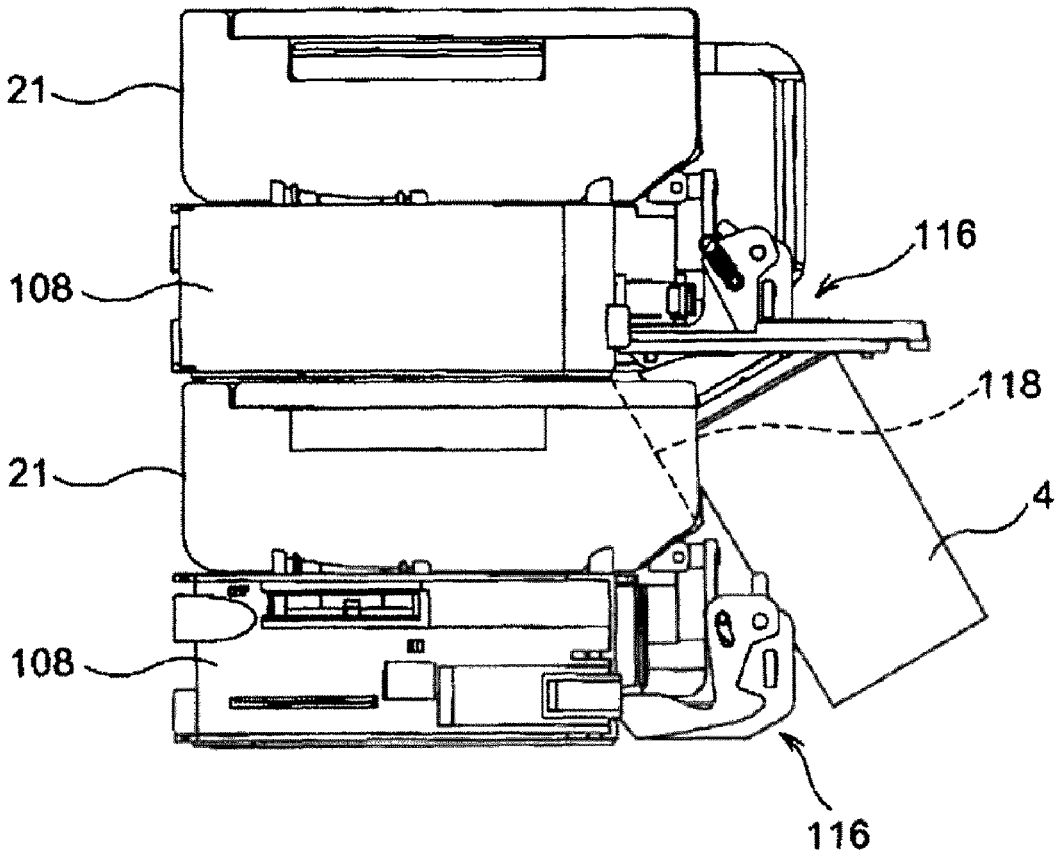
FIG. 12 is a side view when the tablets are filled in a tablet feeder vial.

If the arm 202 of the first vial delivery arm unit 17 holding the vials 4 reaches the tablet feeder 21 and a pressing piece 217 provided in the arm 202 thus pushes the driving piece 128 of the guide unit 116 to fall, then the opening/closing member 120 of the guide unit 119 rotates in a counterclockwise direction as shown in FIG. 11 (*b*) against a pressing force of the coil spring 132, thereby being greatly separated from the tilt plate 119*c* of the stationary guide member 119. Then, after a slight delay, the pin 131 presses an end of the long hole 134 of the movable guide member 121. As a result, the movable guide member 121 also rotates in a counterclockwise direction to move to the operating position as shown in FIG. 11 (*b*). In such a state, the tilt plate 121*b* of the movable guide member 121 and the tilt plate 119*c* of the stationary guide member 119 are continued to form a long tilt surface. Further, since the tilt plate 121*b* of the movable guide member 121 enters the cutout 118 of the tablet feeder 12 at a lower direction, the tilt plate 121*b* does not touch the tablet feeder 21 at a lower direction. Also, as shown in FIG. 12, since the vials also enter the cutout 118 of the tablet feeder 12 at a lower direction, the vials do not touch the tablet feeder 21 at a lower direction.

If the rotor 110 of the tablet feeder 21 is supplied with a power source from the driving shaft 214 of the first vial delivery arm unit 17, then the tablets are discharged from the tablet outlet 112 and guided via the tablet path, which is surrounded by both side portions 119*b* and the tilt plate 119*c* of the stationary guide member 119 and both side portions 121*a* and the tilt plate 121*b* of the movable guide member 121, to the vials 4.

<First Vial Delivery Arm Unit>

Figure 13:
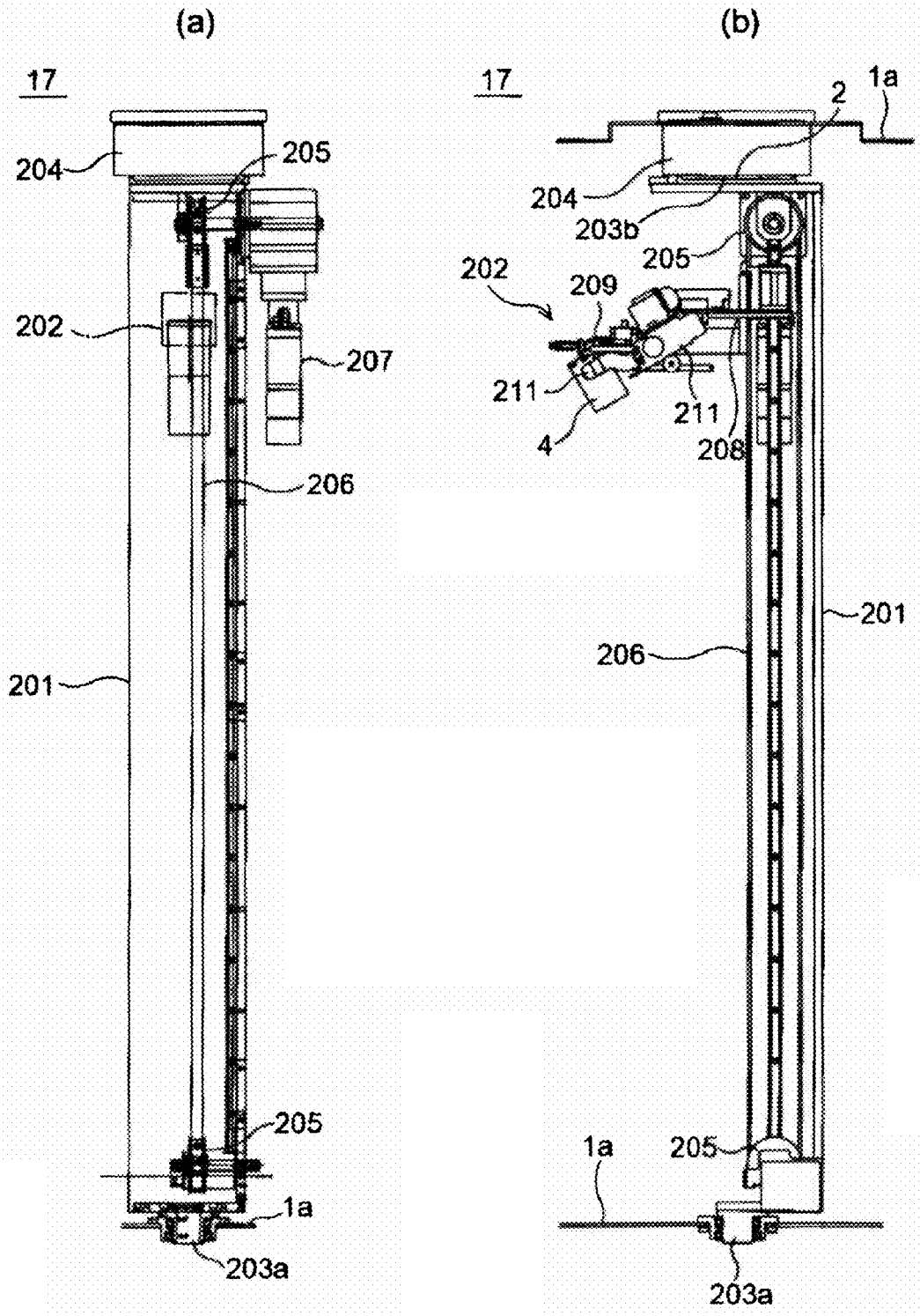
FIG. 13 is a front view (a) and a side view (b) of a first vial delivery arm unit.
Figure 14:
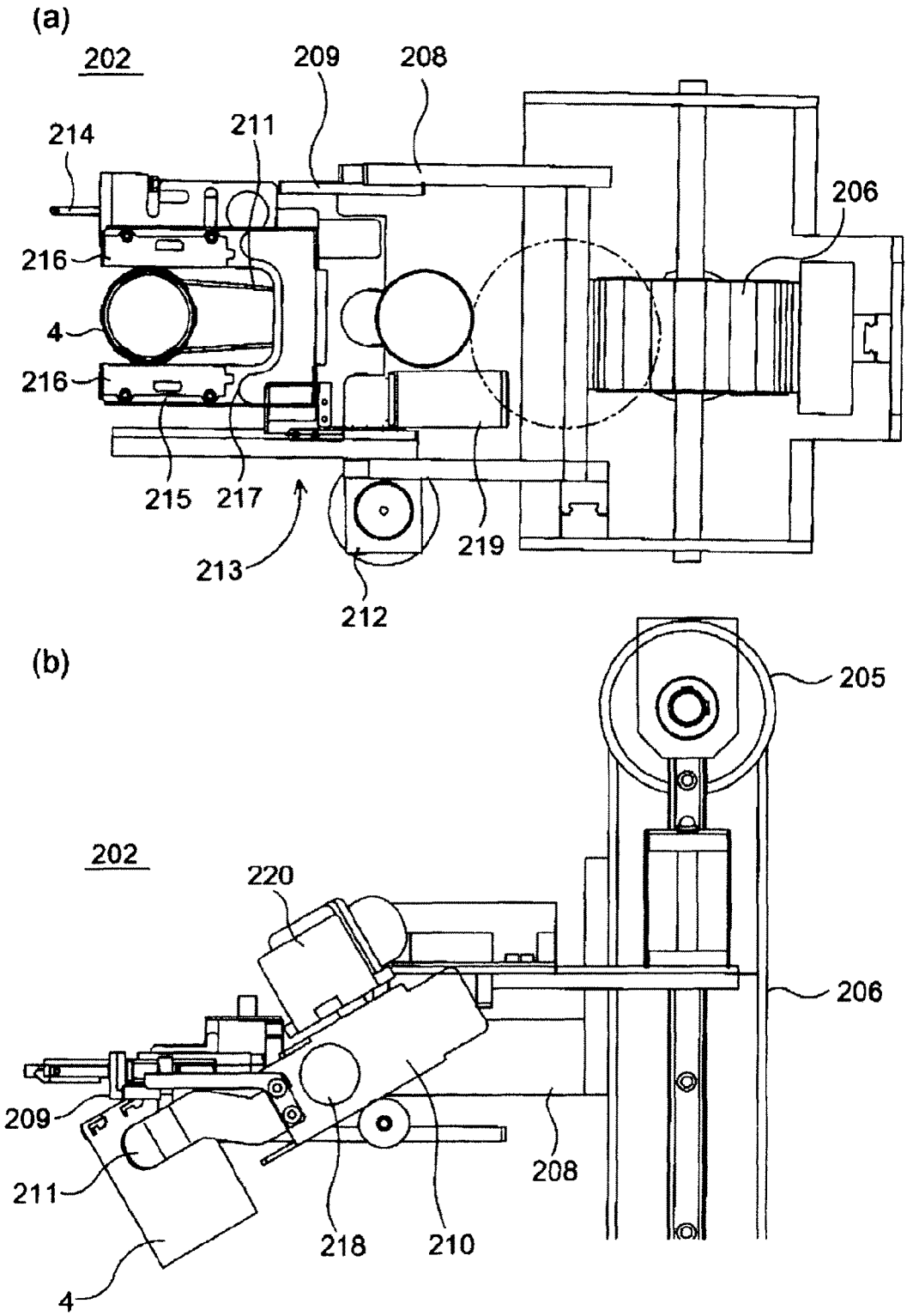
FIG. 14 is a plan view (a) and a side view (b) of an arm of the first vial delivery arm unit.

FIG. 13 shows a front view (a) and a side view (b) of the first vial delivery arm unit 17. FIG. 14 shows a plan view (a) and a side view (b) of the arm 202 of the first vial delivery arm unit. The first vial delivery arm unit 17 includes a swing frame 201 and the arm 202.

The swing frame 201 has a thin and long plate shape with bent upper and lower ends. A shaft 203*a* at the lower end is rotatably provided in the device body 1*a* and a shaft 203*b* at the upper end is fixed at a driving shaft of the motor 204 fixed in the device body 1*a*. Thus, the swing frame 201 is configured to swing around the shafts 203*a* and 203*b* by a rotation of the motor 204. The swing frame 201 has a belt 206 extended between rollers 205 provided at the upper and lower ends. The belt 206 is configured to travel upwardly and downwardly since the roller 205 at the upper end is rotated by a motor 207.

As shown in FIG. 14, the arm 202 includes an arm base 208, a stretchable arm 209, a tilt arm 210 and a grabbing member 211.

The arm base 208 has an approximately U-shape when seen from an upper direction. The arm base 208 is provided at the belt 206 of the swing frame 201 and configured to be lifted along the swing frame 201 by the traveling of the belt 206.

The stretchable arm 209 has an approximately U-shape when seen from an upper direction. The stretchable arm 209 is located at an inner side of the arm base 208 and provided at the arm base 208. The stretchable arm is movably mounted (e.g., adapted to swing, advance, retreat, etc.) in the horizontal direction by a motor 212 and a rack end pinion mechanism 213. A driving shaft 214 is provided about a leading end at one side of the stretchable arm 209. The driving shaft 214 is coupled to the coupling portion 115*a* of the worm gear 115 of the tablet feeder 21 (see FIG. 9) and rotated by a motor (not shown) to thereby rotate the worm gear 115 of the tablet feeder 21. A sensor installing deck 215, which has a U-shape when seen from an upper direction, is provided at an inner side of the stretchable arm 209. Also, a pair of counting sensors 216 for counting the number of the tablets discharged from the tablet feeder 21 is provided at the sensor installing deck 215. Further, a pressing piece 217 for pressing the driving piece 128 of the guide unit 116 of the tablet feeder 21 is provided at the sensor installing deck 215.

The tilt arm 210 is positioned at an inner side of the stretchable arm 209 and provided at the stretchable arm 209 to oscillate around a shaft 218. Thus, the tilt arm 210 is configured to oscillate between a horizontal position and a tilt position by a motor 219.

A pair of grabbing members 211 is provided at the oscillating arm 210 and configured to move in a direction of attaching to and detaching from each other by a motor 220, thereby being capable of grabbing the vials 4.

Figure 15:
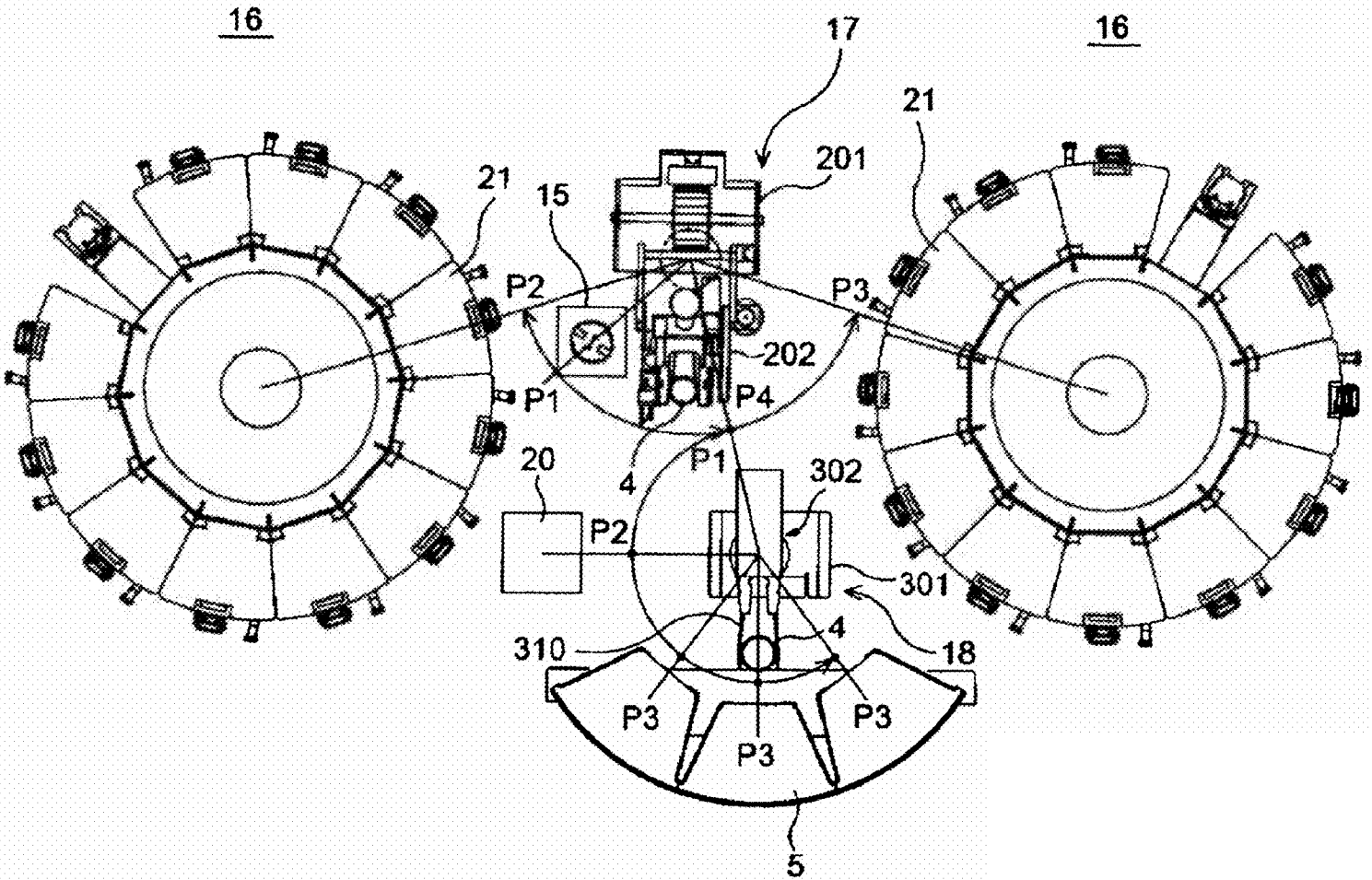
FIG. 15 is a plan view of a driving range of the first and second vial delivery arm units.

As shown in FIG. 15, the first vial delivery arm unit 17 is configured to swing by a rotation of the swing frame 201 to a vial receiving position (first position P1), a first tablet filling position (second position P2), a second tablet filling position (third position P3) and a vial guiding position (fourth position P4). At the first position P1, the first vial delivery arm unit 17 is opposite to the vials 4 lifted while being stacked on the vial lift unit 15. At the second position P2, the first vial delivery arm unit 17 is opposite to the tablet feeder 21 of the tablet supply unit 16 at one side. At the third position P3, the first vial delivery arm unit 17 is opposite to the tablet feeder 21 of the tablet supply unit 16 at the other side. At the fourth position P4, the first vial delivery arm unit 17 is opposite to an arm 302 of the second vial delivery arm 18 unit, as will be explained below.

Operations of the first vial delivery arm unit 17 will be explained below. When the vials 4 supplied from the vial supply unit 11 are delivered to the vial conveyance arm unit 13 by the vial conveyance belt 12, labeled by the labeling unit 14 and then lifted by the vial lift unit 15, the first vial delivery arm unit 17 swings the swing frame 201 to the first position P1 and lowers the arm 202, thereby receiving the vials 4 from the vial lift unit 15 by the grabbing member 211.

When the vials 4 are received, the first vial delivery arm unit 17 swings the swing frame 201 to the second position P2 or third position P3 while lifting the arm 202, thereby being opposite to the tablet feeder 21 filled with the tablets corresponding to the prescription. Next, the stretchable arm 209 is advanced forward while the tilt arm 210 of the arm 202 is tilted at the tilt position, thereby causing the vials 4 to be inclined. At this time, the pressing piece 217 of the stretchable arm 209 presses the driving piece 128 of the guide unit 116 of the tablet feeder 21. This forms the tablet path by the operation of the guide unit 116 as discussed above. Further, the driving shaft 214 of the stretchable arm 209 is coupled to the coupling portion 115*a* of the worm gear 115 of the tablet feeder 21. Here, when the driving shaft 214 is driven, since the tablet feeder 21 is operated, the tablets are discharged from the tablet outlet 112 and thus delivered to the vials 4 via the tablet path.

When the vials 4 are filled with the tablets, since the first vial delivery arm unit 17 swings the swing frame 201 to the fourth position P4 while lifting the arm 202, the vials 4 filled with the tablets are delivered to the second vial delivery arm unit 18.

<The Second Vial Delivery Arm Unit>

Figure 16:
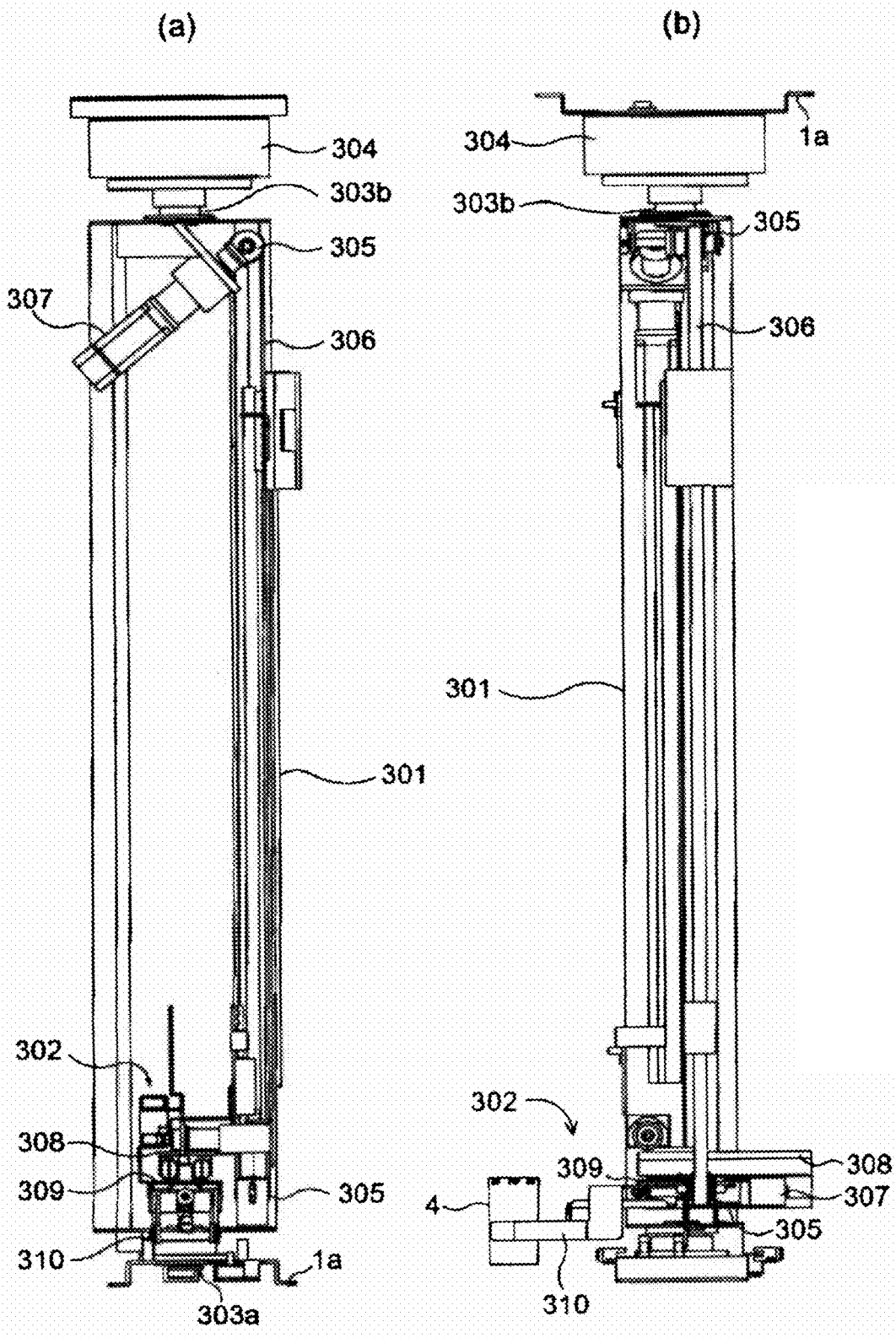
FIG. 16 is a front view (a) and a side view (b) of the second vial delivery arm unit.
Figure 17:
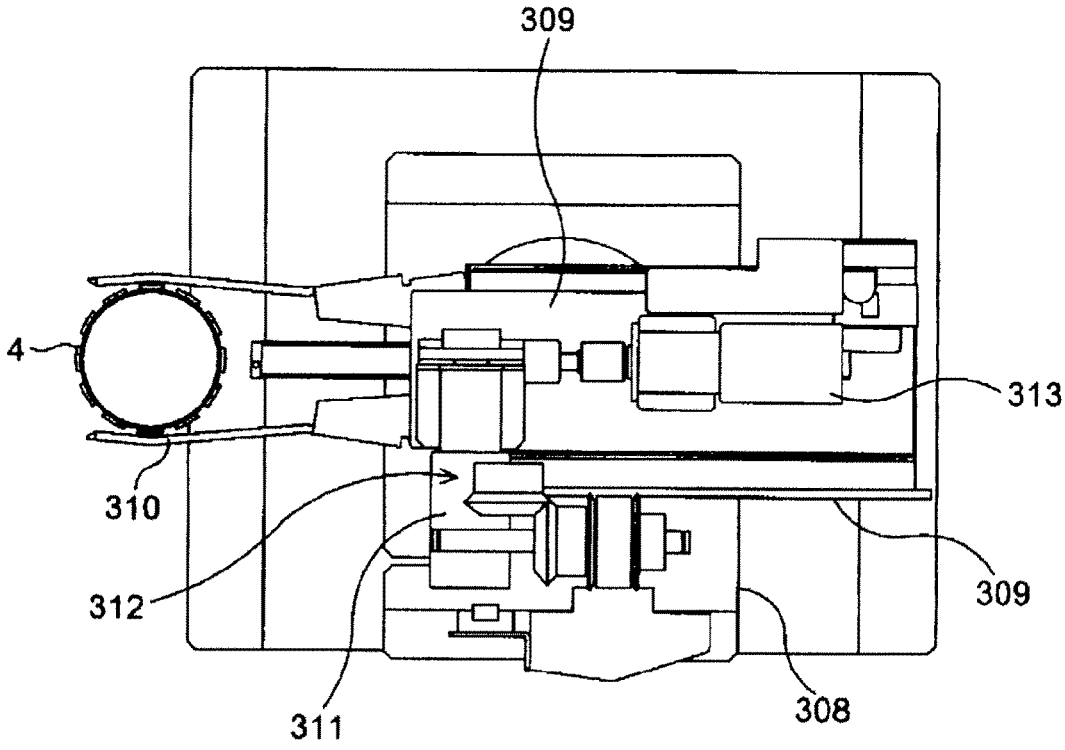
FIG. 17 is a bottom view of the second vial delivery arm unit.

FIG. 16 shows a front view (a) and a side view (b) of the second vial delivery arm unit 18. FIG. 17 shows an expanded bottom view of FIG. 16(*b*). The second vial delivery arm unit 18 includes a swing frame 301 and an arm 302.

The swing frame 301 has a generally thin and long plate shape with bent upper and lower ends. A shaft 303*a* at the lower end is rotatably provided in the device body 1*a* and a shaft 303*b* at the upper end is fixed at a driving shaft of a motor 304 fixed within the device body 1*a*. Thus, the swing frame 301 is configured to swing around the shafts 303*a* and 303*b* by a rotation of the motor 304. The swing frame 301 has a belt 306 extended between rollers 305 provided at the upper and lower ends. The belt 306 is configured to travel upwardly and downwardly since the roller 305 at the upper end is rotated by a motor 307.

As shown in FIG. 17, the arm 302 includes an arm base 308, a stretchable arm 309 and a grabbing member 310. The arm base 308 is provided at the belt 306 of the swing frame 301 and may be lifted along the swing frame 301 by the traveling of the belt 306. The stretchable arm 309 is provided at a lower surface of the arm base 308. The stretchable arm

309 is movably mounted (e.g., configured to advance, retreat, etc.) in the horizontal direction by a motor 311 and a rack end pinion mechanism 312. A pair of the grabbing members 310 is provided at the stretchable arm 309 and may move in a direction of attaching to and detaching from each other by a motor 313, thereby being capable of grabbing the vials 4.

As shown in FIG. 15, the second vial delivery arm unit 18 is configured to swing by a rotation of the swing frame 301 to a vial receiving position (first position P1), a capping position (second position P2) and a plurality of discharging positions (third position P3). At the first position P1, the second vial delivery arm unit 18 is opposite to the arm 202 of the first vial delivery arm unit 17. At the second position P2, the second vial delivery arm unit 18 is opposite to the capping unit 20. At the third position P3, the second vial delivery arm unit 18 is opposite to the extracting shelf 5.

Operations of the second vial delivery arm unit 18 will now be explained below. When the vials 4 filled with the tablets are conveyed by the arm 202 of the first vial delivery arm unit 17, the second vial delivery arm unit 18 swings the swing arm 301 to the first position P1 while lifting the arm 301 to thereby receive the vials from the first vial delivery arm unit 17 by the grabbing member 310.

When the vials 4 are received, the second vial delivery arm unit 18 swings the swing arm 301 to the second position P2 while lifting the arm 302 to thereby deliver the vials 4 filled with the tablets to the capping unit 20. When the caps 3 are provided on the vials 4 by the capping unit 20, the second vial delivery arm unit 18 swings the swing arm 301 to the third position P3 while lifting the arm 302. This stacks the vials 4 closed by the caps 3 on any one of the extracting shelves 5.

As such, an operator can extract the vials 4 stacked on the extracting shelf 5 from an outer side of the device.

Although various embodiments of the present invention are described above, it will be evident to one skilled in the art that various changes and modifications may be made without departing from the invention. It is intended in the appended claims to cover all such changes and modifications that fall within the true spirit and scope of the invention.

The invention claimed is:

1. A tablet feeding device for supplying tablets to vials by removably disposing a tablet feeder in a plurality of mounting bases, supplying a power source to a rotor of the tablet feeder from an outer driving means and discharging the tablets accommodated in the tablet feeder from a tablet outlet, the tablet feeder having a stationary guide member and a movable guide member, the stationary guide member having a stationary tilt plate disposed adjacent to the tablet outlet of the tablet feeder and configured to guide the tablets discharged from the tablet outlet to the vials, the movable guide member having a movable tilt plate movable between a receiving position and an operating position in association with attachment and detachment of the driving means with the tablet feeder for overlapping with the stationary tilt plate at the receiving position and continuing to the stationary tilt plate at the operating position, wherein the tablet feeder is formed with a cutout into which the movable guide member enters when the movable guide member of the tablet feeder is moved to the operating position.

2. The tablet feeding device of claim 1, further comprising an opening/closing member for opening and closing the tablet outlet in association with the attachment and detachment of the driving means with the tablet feeder.

3. The tablet feeding device of claim 2, wherein the movable guide member is moved to the operating position in association with an opening operation of the opening/closing member, and wherein the movable guide member is moved to the receiving position in association with a closing operation of the opening/closing member.

* * * * *